United States Patent [19]

Creasy et al.

[11] 4,131,669

[45] Dec. 26, 1978

[54] SOLUTION OF POLYHYDROXY METHYLENE AND PRODUCTS MADE THEREFROM

[75] Inventors: Walter S. Creasy, Bridgewater; Herbert K. Reimschuessel, Morristown, both of N.J.

[73] Assignee: Allied Chemical Corporation, Morris Township, Morris County, N.J.

[21] Appl. No.: 854,876

[22] Filed: Nov. 25, 1977

[51] Int. Cl.[2] ..... D01D 5/08

[52] U.S. Cl. ..... 264/178 F; 260/29.6 Z; 260/29.6 M; 260/29.6 MM; 264/176 F; 264/184

[58] Field of Search ..... 260/29.6 Z, 29.6 M, 260/29.6 MM, 77.5 UA; 264/178 F, 176 F, 184

[56] References Cited

U.S. PATENT DOCUMENTS

| | | | |
|---|---|---|---|
| 3,331,800 | 7/1967 | Schubel et al. | 260/77.5 UA |
| 3,344,102 | 9/1967 | Hoffman et al. | 260/29.6 M |
| 4,076,680 | 2/1978 | Akkapeddi et al. | 260/77.5 UA |

*Primary Examiner*—Melvyn I. Marquis
*Attorney, Agent, or Firm*—Horst M. Kasper

[57] ABSTRACT

Certain solutions of lithium halides particularly solutions of lithium chloride dissolved readily poly(hydroxymethylene) and copolymers of hydroxymethylene with up to about 30 mol percent of ethylenically unsaturated comonomers at high concentrations suitable for solution spinning. Such solutions are desirable for commercial operation as well as preferred from an economical and toxicological point of view.

14 Claims, No Drawings

SOLUTION OF POLYHYDROXY METHYLENE AND PRODUCTS MADE THEREFROM

FIELD OF THE INVENTION

This invention relates to the preparation of solutions of poly(hydroxymethylene) suitable for spinning and film formation of the polymer.

BACKGROUND OF THE INVENTION

Vinylene carbonate, an unsaturated, cyclic 1,2-substituted ethylene derivative of the formula,

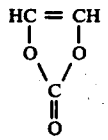

was first prepared and polymerized by M. S. Newman and R. W. Addor (J. Am. Chem. Soc. 75, 1263 (1953) and J. Am. Chem. Soc. 77, 3789 (1955)). Poly(vinylene carbonate) is readily hydrolyzed in basic and acidic media to produce poly(hydroxymethylene) in the form of intractible white powder. Poly(hydroxymethylene) is composed of recurring units of the formula

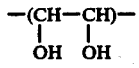

N. D. Fields and J. R. Schaefgen investigated properties of poly(hydroxymethylene) and reported that poly(hydroxymethylene) obtained by hydrolysis of poly(vinylene carbonate) with strong base or aqueous ammonia is a white powdery material soluble only in 30 percent aqueous sodium hydroxide and in sulfuric acid. They found that their high molecular weight polymer was not dissolved but only swollen by hot dimethyl sulfoxide and molten urea. Since the polymer was infusible and could not be fabricated into fibers and films using conventional methods, they made poly(hydroxymethylene) films for determination of mechanical properties of the polymer by first preparing a film of poly(vinylene carbonate) and then hydrolyzing the poly(vinylene carbonate) film to obtain a film of poly(-hydroxymethylene) (J. Polymer Sci. 58, 533 (1962)).

Copolymers of vinylene carbonate with ethylenically unsaturated comonomers have, for example, been disclosed in U.S. Pat. No. 2,722,525 to Price et al. and U.S. Pat. Nos. 2,847,398 and 2,847,401, both to Gluesensamp et al. Such vinylene carbonate copolymers have been hydrolyzed to form the corresponding hydroxymethylene copolymers.

Poly(hydroxymethylene) and copolymers are obtained by processes which involve the polymerization of vinylene carbonate followed by hydrolysis of the poly(vinylene carbonate). It has been found that this polymer is essentially insoluble in all common solvents and solvent systems which are used for polymers and which are characterized by extraordinary solubility properties.

Huffman et al. in U.S. Pat. No. 3,344,102 have disclosed solutions of poly(hydroxymethylene) and of copolymers of hydroxymethylene with certain ethylenically unsaturated comonomers, including vinyl acetate, vinyl chloride, vinyl fluoride, acrylonitrile and acrylamide, in aqueous solution of zinc chloride, which solutions, they stated, are useful for fiber and film formation.

Huffman et al. further disclose that solutions of dimethyl sulfoxide with zinc chloride and of dimethyl acetamide with lithium chloride do not disolve poly(hydroxymethylene).

It has been reported that poly(hydroxymethylene) is soluble in systems such as hydrazine, concentrated alkali, concentrated zinc chloride solution and fused urea. It was reported to be insoluble in solutions such as zinc chloride in dimethyl sulfoxide, alcohols, glycols, dimethylene acetamide and also in a solution of lithium chloride in dimethyl acetamide.

Duvakina et al. in *Zhurnal Prikladnoi Khimii,* Vol. 40, January 1967, page 136 reports the preparation of copolymers of vinylene carbonate with vinyl acetate and Klubikova et al. in *Zhurnal Priklodnoi Khimii,* Vol. 38, 1965, page 1188–1191 report on the copolymerization of vinylene carbonate and vinyl acetate in the presence of redox systems. Furthermore, N. G. Schnautz in *Journal of Polymer Science,* Vol. 14, page 1045 [1976] reports on the radiation copolymerization of vinylene carbonate with isobutyl vinyl ether. While the prior art has addressed itself to the problem of bringing poly(hydroxymethylene) into solution there is still need for a good solvent of this polymer which would enable the fabrication of fibers made from polyhydroxymethylene which is expected to have properties similar to those of cotton.

Poly(hydroxymethylene) and copolymers of hydroxymethyllene containing up to about 30 mol percent of ethylenically unsaturated comonomers may be prepared by polymerizing vinylene carbonate singly or together with ethylenically unsaturated comonomers, by known methods in bulk, solution, suspension or dispersion, under atmospheric or superatmospheric pressure, in the presence of a free radical generating initiator to obtain as precursor polymer poly(vinylene carbonate) or copolymers of vinylene carbonate with ethylenically unsaturated comonomers, followed by hydrolysis of the precursor polymer to obtain poly(hydroxymethylene) or copolymers of hydroxymethylene with ethylenically unsaturated comonomers. Preparation of the poly(vinylene carbonate) and copolymers of vinylene carbonate with ethylenically unsaturated comonomers has, for example, been described in the references discussed above under Background of the Invention.

Ethylenically unsaturated copolymers with vinylene carbonate believed to be useful in the present invention have, for example, been described by Price et al. in U.S. Pat. No. 2,722,525 the disclosure whereof is incorporated herein by reference.

OBJECTS OF THE INVENTION

It is an object of the present invention to provide solutions of poly(hydroxymethylene), including poly(-hydroxymethylene) of high molecular weight and of copolymers of hydroxymethylene with ethylenically unsaturated comonomers.

It is another object of the present invention to provide a method for making fibers and film of poly(hydroxymethylene), of copolymers of hydroxymethylene with ethylenically unsaturated copolymers, and of mixtures thereof.

SUMMARY OF THE INVENTION

In accordance with the present invention, there are provided solutions in aqueous lithium chloride of polymers selected from the group consisting of (a) poly(hydroxymethylene), (b) copolymers of hydroxymethylene with up to about 30 mol percent of ethylenically unsaturated comonomers, and (c) mixtures thereof.

The present invention further provides a method for making fibers and film, of polymers selected from the group consisting of (a) poly(hydroxymethylene), (b) copolymers of hydroxymethylene with up to about 30 mol percent of ethylenically unsaturated comonomers, and (c) mixtures thereof. A spinning solution comprising an aqueous mixture of lithium chloride, bromide or iodide of a concentration of between about 20 weight percent and saturation containing the polymer is extruded by means of an orifice into a coagulation bath comprising a miscible non-solvent for the polymer to precipitate the polymer in fiber or film form from the spinning solution.

Furthermore, the present invention provides a method for obtaining a solution in aqueous lithium chloride, bromide or iodide of a polymer selected from the group consisting of poly(hydroxymethylene) and copolymers of hydroxymethylene with up to about 30 mol percent of ethylenically unsaturated comonomer which comprises dissolving a precursor polymer selected from the group consisting of poly(vinylene carbonate) and copolymers of vinylene carbonate with up to about 30 mol percent of ethylenically unsaturated comonomer in aqueous lithium chloride. Preferably the lithium chloride solution also contains zinc or magnesium chloride, bromide or iodide.

DETAILED DESCRIPTION OF THE INVENTION AND OF THE PREFERRED EMBODIMENTS

Ethylenically unsaturated comonomers for making copolymers thereof with vinylene carbonate have, for example, been described by Price et al. in U.S. Pat. No. 2,722,525. These comonomers include compounds of the formula $CH_2=CRR'$, wherein R may be hydrogen, halogen, alkyl, cycloalkyl or aryl radicals, and R' may be aryl and alkaryl radicals, or radicals of the formulas

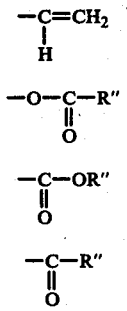

wherein R'' may be alkyl, alkoxyalkyl, or a carbocyclic radical. Exemplary comonomers of the formula $CH_2=CRR'$ include those wherein R is hydrogen; a halogen, such as fluorine, chlorine, bromine or iodine; alkyl, for example, methyl, ethyl, propyl, butyl, 2-octadecyl, etc.; cycloalkyl such as cyclopentyl, cyclohexyl, cycloheptyl, etc.; aryl, for example, phenyl, xenyl, naphthyl etc.; alkaryl, for examply tolyl, xylyl, ethylphenyl, etc.; and aralkyl, for example, benzyl, phenylethyl, etc.; and wherein R; may be a radical of any of the above shown formulas wherein R'' may be alkyl, alkoxyalkyl, for example, methoxymethyl, methoxyethyl, ethoxypropyl, propoxybutyl, etc.; or a carbocyclic radical, for example, aryl, alkaryl, or hydroaromatic, etc.

Exemplary compounds of the formula $CH_2=CRR'$ include vinyl esters, for example, vinyl acetate, vinyl propionate, vinyl butylate, etc.; methyl vinyl ketone; ethyl vinyl ketone; isoprene, 1,3-butadiene, 2-chloro-1,3-butadiene; various esters of acrylic acid, for example methyl acrylate, ethyl acrylate, cyclohexyl acrylate, tetrahydronaphthyl acrylate, decahydronaphthyl acrylate, methoxyethyl acrylate, ethoxyethyl acrylate, and the like.

Suitable comonomers further include ethylene and halo-substituted ethylene, such as vinyl and vinylene halides, e.g. vinyl chloride, vinyl fluoride, vinyl bromide, vinyl iodide, vinylene chloride, vinylene fluoride, 1-fluoro-1-chloroethylene, 1-fluoro-1-bromoethylene, vinylene bromide, also comonomers of the formula $CF_2=CXY$, wherein X may be hydrogen, chlorine or fluorine and Y may be chlorine or fluorine, for example, tetrafluoroethylene, chlorotrifluoroethylene, trifluoroethylene, 1,1-dichloro-2,2-difluoroethylene, and the like.

Further included are vinylethers having the formula $CH_2{=}CH{-}O{-}R$ wherein R is alkyl, straight chain or branched, having 1 to 10 carbon atoms, such as vinyl isobutylether, and the like.

Polymer of vinyl carbonate or copolymers thereof with up to about 30 mol percent of ethylenically unsaturated comonomers, as above described, are obtained by known polymerization methods which ordinarily yield the polymer in the form of granules or powder. They may be simply converted to the corresponding poly(hydroxymethylene) or the corresponding copolymers by suspending the granules or powder in aqueous or alcoholic alkali or concentrated aqueous ammonia, under heating, if desired, to precipitate the insoluble poly(hydroxymethylene) or corresponding copolymer. We have found that the vinylene carbonate precursor polymer is susceptable to oxidation in air and that, if the hydrolysis is conducted in aqueous alkali (for example, aqueous KOH), severe chain degradation may result. For that reason, it is preferred to conduct the alkaline hydrolysis in an inert atmosphere, e.g. under a blanket of nitrogen, helium, argon, or the like. More preferably, conversion of the precursor polymer to the poly(hydroxymethylene) or corresponding copolymer may be accomplished by hydrazinolysis, desirably in substantially anhydrous hydrazine, as hereindefined, to obtain solutions thereof in hydrazine directly. From these solutions the poly(hydroxymethylene) or copolymer may be precipitated by addition of a non-solvent, such as water.

Unexpectedly it was found that poly(hydroxymethylene) is soluble in concentrated solutions of lithium halide such as lithium chloride and lithium bromide in solvents such as water, dimethyl sulfoxide, formamide, dimethyl acetamide/water and dimethyl sulfoxide/water. Solutions containing up to 25 weight percent of poly(hydroxymethylene) can be readily prepared depending on the polymer molecular weight of the poly(hydroxymethylene).

An aqueous solution of concentration in the range of about 20% to saturation of lithium chloride, bromide or iodide permissably containing other salts and/or solvents dissolves polyhydroxymethylene to form a viscous solution. The additional salt or salts present can be various salts, especially magnesium chloride, zinc chloride, cupric chloride, nickel chloride, cobalt chloride, ferrous chloride, manganese chloride, chromous chloride; and the additional solvent can be, in general, any polar solvent, e.g. dimethyl sulfoxide, dimethyl acetamide, dimethyl formamide, formamide, acetamide.

Solutions of poly(hydroxymethylene) and of copolymers of hydroxymethylene with ethylenically unsaturated comonomers in accordance with the present invention are simply prepared by suspending the polymer is aqueous lithium chloride, with agitation and under heating, until solution is effected. When the solution is allowed to cool to ambient temperature the polymer in general precipitates.

The polymer solution thus obtained can serve as spinning solution for making filaments and film of the polymer by known methods of solution spinning, as by forcing the solution through a filtering device and then through an orifice in the form of a slot, if a film is desired, or through a spinneret if a filament is desired, into a coagulating bath (spinning bath), which may be any liquid miscible with aqueous lithium halide solution which is a non-solvent for the polymer, optionally followed by washing and drying of the film or filament thus obtained. Exemplary liquid media suitable to serve as coagulating bath include water, dilute aqueous lithium halide solution, alcohols such as methanol and ethanol, and the like. The solution is extruded into the coagulation bath, and then the resulting structure is preferably fed into a second bath to complete extraction of any remaining salt. From this bath the formed structure is fed to takeup rolls which operate at selected speeds; e.g. at differential speeds for filament production, resulting in a drawing of the filament to about 3–5 times of its original length, with resulting orientation of the filament.

The resulting filaments generally have mechanical properties suitable for textile yarn and for industrial yarn. Since these textile fibers have hydrophilic properties, they are eminently suitable for fabrication into wearing apparel having appearance and properties similar to natural fibers of plant origin, such as cotton.

Inclusion of comonomers into the poly(hydroxymethylene) structure may serve to enhance solubility and tends to disrupt crystallinity of the poly(hydroxymethylene), thereby modifying properties such as flexibility, etc.

PREFERRED EMBODIMENTS

Aqueous solutions of between about 30 weight percent to saturation are preferred for dissolving poly(hydroxymethylene). Preferably about 2–5 weight percent of magnesium chloride is added to the solution. Polar cosolvents can be added. Preferably dimethyl formamide and dimethylacetamide are added to lithium chloride solutions by up to 50 weight percent.

The solution is heated to temperatures between about 30 to 150° C. and preferably to temperatures between 40 and 80° C.

To the solution polyhydroxymethylene is added in amounts of between about 5 to 30 percent by weight, preferably between about 10 and 20 percent by weight.

The solution containing the poly(hydroxymethylene) is stirred and agitated for a time of between about 2 hours and 2 days, preferably between 3 hours and 24 hours at the temperature selected. Preferably the solution of the poly(hydroxymethylene) is filtered at the selected temperature.

Using an essentially aqueous lithium chloride solution of the poly(hydroxymethylene) for spinning, water is a preferred coagulant. More dilute aqueous solutions of lithium chloride can also be employed. Preferably aqueous solutions of between about 60 and 70 percent of saturation of lithium chloride were used to control the rate of coagulation effectively.

Preferably the temperature of the coagulating bath is about the same as the temperature of the polyhydroxymethylene solution.

Controlling the rate of coagulation influences the amount of microvoids in the resulting fiber. It has been found that slow and controlled coagulation results in a minimization of the number of microvoids. Spinning a solution of a polymer of the present invention into a bath containing as a coagulant solely a non-solvent for the polymer results in general in a fiber with a "kidney-shaped" cross section. Spinning the solution of a polymer of the present invention into a bath containing as a coagulant a solvent-non-solvent composition for the polymer, then a gradual coagulation proceeds and the resulting fiber is of nearly circular crosssection and essentially free of microvoids.

The following examples further illustrate the present invention and set forth the best mode presently contemplated for its practice.

EXAMPLE 1

An aqueous lithium chloride solution, saturated at room temperature (approximately 13M) was prepared; 21.25g was heated to 75° C. and to this was added 3.75g of poly(hydroxymethylene) ($\eta_{inh}$ [hydrazine] = 1.3). The viscosity was determined in 0.5% hydrazine solution. After stirring for about 3 hrs. at 75–80° C., the polymer was found to have dissolved completely, giving a clear, light amber, viscous solution. On cooling to 25° C., the solution remained free flowing but highly viscous. Polymer recovered from this solution by precipitation in water had $\eta_{inh}$ [hydrazine] = 1.20.

EXAMPLE 2

A solution was prepared as in Example 1 using poly(hydroxymethylene) of inherent viscosity 1.72. After recovery from solution, the inherent viscosity was 1.60.

EXAMPLE 3

A solution was prepared as in Example 1 except that a saturated aqueous solution of lithium bromide was substituted for the saturated aqueous lithium chloride solution.

EXAMPLE 4

A saturated room temperature solution of lithium chloride in dimethylsulfoxide was prepared, 9g was heated to 75° C. and to this was added 1g of poly(hydroxymethylene) ($\eta_{inh}$ [hydrazine] = 1.5). After stirring for about 15 hrs. at 75–80° C., the polymer was found to have dissolved, giving a clear, light amber, very viscous solution.

EXAMPLE 5

A 1:1 molar $H_2O$/DMSO solution, saturated with lithium chloride, was found to dissolve poly(hydroxymethylene) when treated as in Example 4. The polymer precipitates when the solution is allowed to cool to ambient temperature.

EXAMPLE 6

A 3:1 molar $H_2O$/dimethylacetamide solution, saturated with lithium chloride, was found to dissolve poly(hydroxymethylene) when treated as in Example 4. The polymer precipitates when the solution is allowed to cool to ambient temperature.

EXAMPLE 7

A saturated room temperature solution of lithium chloride in 9g formamide, was heated to 75° C. and to this was added 1g of poly(hydroxymethylene) ($\eta_{inh}$ [hydrazine] = 1.5). After stirring about 24 hrs. at 75–80° C., the polymer was found to have partially dissolved. The clear solution, when separated, was added to water giving a white precipitate of poly(hydroxymethylene).

EXAMPLE 8

A solution was prepared as in Example 1, except that a saturated, aqueous solution of lithium iodide was substituted for lithium chloride.

EXAMPLE 9

A 5 percent solution of poly(hydroxymethylene) ($\eta_{inh}$ = 1.55) was prepared as in Example 1. To a sample of this solution was added a nonsolvent, as shown in the table below. The resultant mixture was then heated to temperatures up to 100° C. in order to determine the maximum amount of such nonsolvent which could be added while maintaining significant polymer solubility.

| Nonsolvent | Maximum Percentage in Mixture Allowing Polymer Solubility of 2% by Wt. at Specified Temperature | T, ° C |
|---|---|---|
| Dimethyl-formamide | 90+ | 100 |
| 65% Hydrazine | 90+ | 100 |
| Dimethyl-Acetamide | 90+ | 100 |
| Water | 40 | 100 |
| Ethylene Glycol | 35 | 100 |
| Acetone | 25 | 56 |
| Tetrahydrofuran | 25 | 64 |
| Methanol | 5 | 64 |

EXAMPLE 10

A 5 percent solution of poly(hydroxymethylene) ($\eta_{inh}$ = 1.55) in aqueous lithium chloride/dimethyl sulfoxide was prepared as in Example 4. Nonsolvents were added to samples of this solution, as in Example 9, in order to determine the maximum amount of such nonsolvent which could be added while maintaining significant polymer solubility.

| Nonsolvent | Maximum Percentage in Mixture Allowing Polymer Solubility of 2% by Wt. at Specified Temperature | T, ° C |
|---|---|---|
| Dimethyl-formamide | 90+ | 100 |
| Dimethyl-Acetamide | 90+ | 100 |
| 64% Hydrazine | 20 | 100 |
| Water | 20 | 100 |
| Ethylene Glycol | 20 | 100 |
| Acetone | 20 | 56 |
| Tetrahydrofuran | 20 | 64 |
| Methanol | 10 | 64 |

EXAMPLE 11

From a saturated room temperature solution containing lithium chloride (40.2%) plus magnesium chloride (5.68%)[1], 19.9g was heated to approximately 90° C., and to this was added 0.1g of poly(hydroxymethylene), ($\eta_{inh}$ = 0.90). After stirring for 12 hours at 85–90° C. the polymer was found to have dissolved giving a clear viscous, light amber solution. The polymer precipitated when the solution was cooled to 25° C. Other $LiCl/MgCl_2$ saturated solutions found to dissolve poly(-hydroxymethylene) are as follows:

| LiCl (%) | $MgCl_2$ (%) | Approximate Solubility of Poly(hydroxymethylene) ($\eta_{inh}$ = .90) at 25° C |
|---|---|---|
| 35.4 | 8.32 | 5% |
| 22.0 | 18.0 | 2% |

The solubility of poly(hydroxymethylene) ($\eta_{inh}$ = 0.90) in 35.4% aqueous LiCl solution alone is 2% by wt.

1. Solubility of Inorganic and Organic Compounds, Sidell and Kubde, Suppl. to 3rd Ed. (1952), D. Van Nostrand Co., NY)

EXAMPLE 12

To demonstrate the spinning of filaments of poly(hydroxymethylene) the following experiment was conducted:

To a 42% aqueous solution of LiCl was added at about 75° C. poly(hydroxymethylene) having an inherent viscosity of 1.5 until a 20% polymer solution was obtained. This solution was filtered, degased, and transferred into a motor driven syringe. Employing a needle with an open diameter of 0.006 in, and a temperature of about 50° C., the solution was extruded first into an aqueous coagulation bath which was held at room temperature, then fed into a second water bath to complete extraction of any remaining salt. From this bath the formed filament was fed consecutively into take-up rolls which operated at different speeds resulting in a drawing of the filament to about four times its original length. This operation yielded filaments with deniers between 30 and 65, tensile moduli between 120 and 220 g/d at ranges of 2 to 4 g/d and 6% to 20% for tensile strength and elongation, respectively.

EXAMPLE 13

A solution of poly(hydroxymethylene) in aqueous lithium chloride was prepared as in 12. This solution was then extruded into a coagulation bath that contained as a coagulant a 32.0% aqueous solution of LiCl at 45° to 50° C. The filament formed upon coagulation was then processed as in example 12. Whereas the filaments obtained according to example 12 had a "kidney-shaped" cross-section — typical for many solution spun fibers — the filaments according to 13 had a circular cross-section and were essentially free of microvoids, and had tensile strengths in the range of 6 to 7 g/d at 15% to 20% elongations.

EXAMPLE 14

When copolymers of vinyl carbonate with up to about 30 mol percent of ethylenically unsaturated comonomers are hydrolyzed in accordance with the procedure of Example I, above, then corresponding poly(-hydroxymethylene) copolymers are obtained which are soluble in aqueous lithium chloride. Their solution in aqueous lithium chloride can be spun into filaments by extrusion into a spinning bath, as above illustrated for poly(hydroxymethylene).

Since various changes and modifications may be made in the invention without departing from the spirit and essential characteristics thereof, it is intended that all matter contained in the above description shall be interpreted as illustrative, only the invention being limited by the scope of the appended claims.

We claim:

1. Compositions consisting essentially of a polymer selected from the group consisting of (a) poly(hydroxymethylene), (b) copolymers of hydroxymethylene with up to about 30 mol percent of ethylenically unsaturated comonomers, and (c) mixtures thereof, dissolved in an aqueous solution comprising lithium chloride, bromide or iodide at concentration from 20 weight percent to saturation at the prevailing temperature.

2. The compositions as set forth in claim 1 wherein the solution additionally contains magnesium chloride or zinc chloride.

3. A solution according to claim 1 wherein the solution additionally contains a polar cosolvent.

4. A solution according to claim 2 wherein the polymer is poly(hydroxymethylene).

5. A method for forming a solution according to claim 1 which comprises dissolving a precursor polymer selected from the group consisting of poly(vinylene carbonate) and copolymers of vinylene carbonate with up to about 30 mol percent of ethylenically unsaturated comonomer in aqueous solution containing lithium chloride, bromide or iodide from concentration from 20 weight percent to saturation and heating the solution thus obtained.

6. The method of claim 5 wherein the precursor polymer is poly(vinylenecarbonate), and solution obtained is a solution of poly(hydroxymethylene).

7. The method of forming a solution of water insoluble polymers of poly(hydroxymethylene) containing (—CHOH—CHOH—) linkages which comprises contacting said polymers with an aqueous solution of lithium chloride, bromide or iodide at a concentration from about 20 weight percent to saturation.

8. A method for making filament of a polymer selected from the group consisting of (a) poly(hydroxymethylene), (b) copolymers thereof with up to about 30 mol percent of ethylenically unsaturated comonomers, and (c) mixtures thereof which comprises introducing a spinning solution comprising a solution of said polymer, in an aqueous solvent mixture of a concentration of between about 20 weight percent to saturation of lithium chloride, bromide or iodide by means of a spinneret into a spinning bath comprising an aqueous lithium chloride-bromide-or iodide-miscible nonsolvent for said polymer to precipitate said polymer in filamentary form from the spinning solution.

9. The method of claim 8 wherein the spinning bath comprises water.

10. The method of claim 8 wherein the spinning bath is an aqueous lithium chloride, bromide or iodide solution of a concentration of less than about 60 percent of saturation at the respective temperature.

11. The method of claim 8 wherein the polymer is poly(hydroxymethylene).

12. The method of claim 10 wherein the spinning bath comprises water and the polymer is precipitated in the spinning bath in fiber form.

13. The method of claim 10 wherein the spinning bath comprises water and the polymer is precipitated in the spinning bath in film form.

14. A method of producing poly(hydroxymethylene) fibers comprising (a) dissolving poly(hydroxymethylene) in aqueous lithium chloride;

(b) spinning and extruding the solution into a bath;

(c) removing and stretching the resulting fiber.

* * * * *